US010018933B2

(12) United States Patent
Tsujihiro

(10) Patent No.: US 10,018,933 B2
(45) Date of Patent: Jul. 10, 2018

(54) ELECTROSTATIC LATENT IMAGE DEVELOPING TONER

(71) Applicant: KYOCERA Document Solutions Inc., Osaka (JP)

(72) Inventor: Masami Tsujihiro, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/278,361

(22) Filed: Sep. 28, 2016

(65) Prior Publication Data

US 2017/0090315 A1 Mar. 30, 2017

(30) Foreign Application Priority Data

Sep. 30, 2015 (JP) ..... 2015-193132

(51) Int. Cl.
*G03G 9/093* (2006.01)

(52) U.S. Cl.
CPC ..... *G03G 9/09392* (2013.01); *G03G 9/09314* (2013.01); *G03G 9/09321* (2013.01); *G03G 9/09371* (2013.01); *G03G 9/09378* (2013.01)

(58) Field of Classification Search
CPC ..... G03G 9/09392; G03G 9/09314; G03G 9/09321; G03G 9/09371; G03G 9/09378
See application file for complete search history.

(56) References Cited

U.S. PATENT DOCUMENTS 4,740,443 A * 4/1988 Nakahara ..... G03G 9/0825 430/108.24

FOREIGN PATENT DOCUMENTS

JP 2012-189940 A 10/2012
JP 2013-195679 A 9/2013
JP 2013-195682 A 9/2013

OTHER PUBLICATIONS

An Office Action; "Notification of Reasons for Refusal," mailed by the Japanese Patent Office dated Feb. 27, 2018, which corresponds to Japanese Patent Application No. 2015-193132 and is related to U.S. Appl. No. 15/278,361; with English Translation.

* cited by examiner

*Primary Examiner* — Thorl Chea
(74) *Attorney, Agent, or Firm* — Studebaker & Brackett PC

(57) ABSTRACT

An electrostatic latent image developing toner includes toner particles each including a toner core and a shell layer. The shell layer includes first and second domains. The first domain includes a first copolymer of a first main monomer having a mole fraction of at least 20 mol % and one or more first additional monomers each having a mole fraction of less than 20 mol %. The second domain includes a second copolymer of a second main monomer having a mole fraction of at least 20 mol % and one or more second additional monomers each having a mole fraction of less than 20 mol %. A difference in polymer SP value between the first and second main monomers is at least 0.5 and no greater than 5.0. The first and second additional monomers each include one or more common monomers having a homopolymerization glass transition point of no greater than −20° C.

10 Claims, 2 Drawing Sheets

ELECTROSTATIC LATENT IMAGE DEVELOPING TONER

INCORPORATION BY REFERENCE

The present application claims priority under 35 U.S.C. § 119 to Japanese Patent Application No. 2015-193132, filed on Sep. 30, 2015. The contents of this application are incorporated herein by reference in their entirety.

BACKGROUND

The present disclosure relates to an electrostatic latent image developing toner, and in particular relates to a capsule toner.

Toner particles included in a capsule toner each include a core and a shell layer (capsule layer) disposed over a surface of the core. The shell layer covers the core of each toner particle of the capsule toner. A toner has been known for example that includes shell layers each having double structure formed according to a polymerization method called seed polymerization. The shell layers of the toner are each formed of two resins (a binder resin and resin particulates). A resin contained in cores of the toner has substantially the same SP value as one of the resins (binder resin) of the shell layers.

SUMMARY

An electrostatic latent image developing toner according to the present disclosure includes a plurality of toner particles each including a core and a shell layer disposed on a surface of the core. The shell layer has a first domain and a second domain. The first domain includes a first copolymer of one or more first main monomers each having a mole fraction of at least 20 mol % and one or more first additional monomers each having a mole fraction of less than 20 mol %. The second domain includes a second copolymer of one or more second main monomers each having a mole fraction of at least 20 mol % and one or more second additional monomers each having a mole fraction of less than 20 mol %. A difference in polymer SP value between the one or more first main monomers and the one or more second main monomers calculated according to Fedors' method is at least 0.5 and no greater than 5.0. The one or more first additional monomers and the one or more second additional monomer each include one or more common monomers each having a homopolymerization glass transition point of no greater than −20° C.

DETAILED DESCRIPTION

Figure 1:
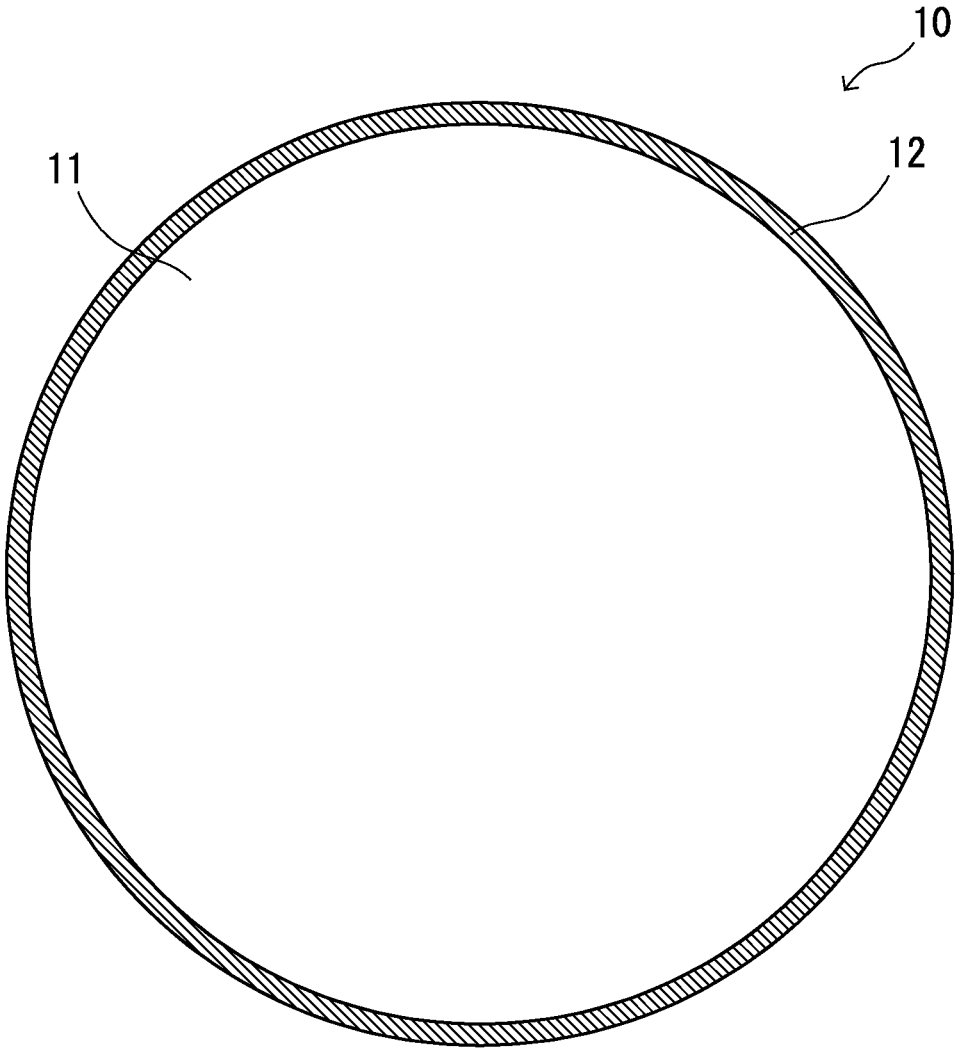
FIG. 1 is a cross sectional view illustrating an example of a toner particle (specifically, a toner mother particle) included in an electrostatic latent image developing toner according to an embodiment of the present disclosure.

The following explains an embodiment of the present disclosure in detail.

Unless otherwise stated, evaluation results (for example, values indicating shape and physical properties) for a powder (specific examples include toner cores, toner mother particles, an external additive, and a toner) are number averages of values measured for a suitable number of particles. Unless otherwise stated, the number average particle diameter of a powder is a number average value of equivalent circular diameters of respective primary particles (diameters of circles having the same areas of projected areas of the respective particles) measured using a microscope. Unless otherwise stated, a measured value of a volume median diameter ($D_{50}$) of a powder is a value measured using "Coulter Counter Multisizer 3" produced by Beckman Coulter, Inc. Respective measured values of an acid value and a hydroxyl value are values measured in accordance with Japan Industrial Standard (JIS) K0070-1992, unless otherwise stated. Respective measured values of a number average molecular weight (Mn) and a mass average molecular weight (Mw) are values measured by gel permeation chromatography, unless otherwise stated.

In the present description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. In the present description, the term "(meth)acryl" is used as a generic term for both acryl and methacryl. Also, the term "(meth)acryloyl group" is used as a generic term for both an acryloyl group ($CH_2{=}CH{-}CO{-}$) and a (meth)acryloyl group ($CH_2{=}C(CH_3){-}CO{-}$).

A toner according to the present embodiment can be favorably used for example as a positively chargeable toner for development of an electrostatic latent image. The toner according to the present embodiment is a powder including a plurality of toner particles (particles each having structure described later). The toner may be used as a one-component developer. Alternatively, a two-component developer may be prepared by mixing the toner with a carrier using a mixer (specific examples include a ball mill). A ferrite carrier is preferably used as a carrier in order to form a high-quality image. It is preferable to use magnetic carrier particles each including a carrier core and a resin layer that covers the carrier core in order to form high-quality images for a long period of time. Carrier cores may be formed from a magnetic material (for example, a ferromagnetic material such as ferrite) or a resin in which magnetic particles are dispersed in order to impart magnetism to the carrier particles. Alternatively, magnetic particles may be dispersed in a resin layer that covers the carrier core. The amount of the toner in a two-component developer is preferably at least 5 parts by mass and no greater than 15 parts by mass relative to 100 parts by mass of the carrier in order to form a high-quality image. Note that a positively chargeable toner included in a two-component developer is positively charged by friction with the carrier.

The toner particles included in the toner according to the present embodiment each include a core (also referred to below as a toner core) and a shell layer (capsule layer) disposed over a surface of the toner core. The toner core contains a binder resin. The toner core may optionally contain an internal additive (for example, a colorant, a releasing agent, a charge control agent, and a magnetic powder). An external additive may be attached to a surface of the shell layer (or a surface region of the toner core that is not covered with the shell layer). Note that the external additive may be omitted in a situation in which such additives are not necessary. Hereinafter, toner particles that are yet to be subjected to addition of an external additive are referred to as toner mother particles. A material for forming the shell layers is referred to as a shell material.

The toner according to the present embodiment can be used for example for image formation in an electrophotographic apparatus (image forming apparatus). Following describes an example of an image forming method using an electrophotographic apparatus.

First, an image forming section (a charger and an exposure device) of the electrophotographic apparatus forms an electrostatic latent image on a photosensitive member (for example, a surface layer portion of a photosensitive drum) based on image data. Next, the formed electrostatic latent image is developed using a developer containing a toner. In a development process, toner (for example, toner charged by friction between the toner and the carrier or a blade) on a development sleeve (for example, a surface layer portion of a development roller in the developing device) disposed in the vicinity of the photosensitive member is attached to the electrostatic latent image to form a toner image on the photosensitive member. In a subsequent transfer process, the toner image on the photosensitive member is transferred to an intermediate transfer member (for example, a transfer belt), and the toner image on the intermediate transfer member is further transferred to a recording medium (for example, paper). Thereafter, a fixing device (fixing method: nip fixing using a heating roller and a pressure roller) applies heat and pressure to the toner to fix the toner to the recording medium. As a result, an image is formed on the recording medium. A full-color image can be formed by superimposing toner images formed using different colors, such as black, yellow, magenta, and cyan. A belt fixing method may be adopted as a fixing method.

The toner according to the present embodiment is an electrostatic latent image developing toner having the following structure (also referred to below as basic structure).

(Basic Structure of Toner)

The electrostatic latent image developing toner includes a plurality of toner particles each including a toner core and a shell layer. The shell layer has a first domain and a second domain. The first domain includes a copolymer (also referred to below as a first copolymer) of a monomer (also referred to below as a first main monomer) having a mole fraction of at least 20 mol % and a monomer (also referred to below as a first additional monomer) having a mole fraction of less than 20 mol %. The second domain includes a copolymer (also referred to below as a second copolymer) of a monomer (also referred to below as a second main monomer) having a mole fraction of at least 20 mol % and a monomer (also referred to below as a second additional monomer) having a mole fraction of less than 20 mol %. A difference in polymer SP value (absolute value) between the first main monomer and the second main monomer calculated by Fedors' method is at least 0.5 and no greater than 5.0. The first and second additional monomers each include at least one common monomer (also referred to below as a low-Tg common monomer) having a homopolymerization glass transition point of no greater than −20° C. Note that the homopolymerization glass transition point (also referred to below as a homopolymerization Tg) of a monomer is a glass transition point of the monomer subjected to homopolymerization. Hereinafter, the first domain and the second domain may be referred collectively to as "domains". The first main monomer and the second main monomer may be referred collectively to as "main monomers". Also, the first additional monomer and the second additional monomer may be referred collectively to as "additional monomers". The first copolymer and the second copolymer may be referred collectively to as "copolymers".

In a configuration in which a monomer of either or both of the copolymers include two or more main monomers (monomers each having a mole fraction of at least 20 mol %), whether the aforementioned prerequisite as to the difference in SP value defined for the above basic structure is met is determined based on a SP value of a copolymer of the two or more main monomers. In a configuration for example in which the respective copolymers of the first and second domains each include two or more main monomers among monomers forming the respective copolymers, it is determined whether or not a difference (absolute value) in SP value between a copolymer of all of the main monomers in the first domain and a copolymer of all of the main monomers in the second domain is at least 0.5 and no greater than 5.0.

In the above basic structure, the term "common monomer" is defined as a monomer of the same type (except the main monomers) included in common in the additional monomer(s) in the first domain and the additional monomer (s) in the second domain. The term "low-Tg common monomer" is defined as a common monomer having a homopolymerization Tg of no greater than −20° C. The types of monomers are classified in accordance with CAS registry number or the like. Monomers of the same type can be represented by the same chemical formula. Monomers of the same type have the same SP value of a homopolymer calculated according to Fedors' method.

A solubility parameter (SP value) calculated according to Fedors' method is expressed by an equation "SP value=$(E/V)^{1/2}$" where E represents a molecular cohesive energy [cal/mol] and V represents a molar molecular volume of a solvent [$cm^3$/mol]). Details of Fedors' method are described in the following literature A.

Literature A: R. F. Fedors, "Polymer engineering and science", vol. 14, no. 2, pp. 147-154, 1974.

Details of a calculation method of a homopolymerization Tg of a monomer (glass transition point when the monomer is homopolymerized) are described in the following literature B.

Literature B: Seizo Okamura and other six persons, "Introduction of macromolecule chemistry", second edition, Kagaku-Dojin Publishing Co., Inc., p. 172 (particularly, expression of Fox at 4-69).

Table 1 indicates SP values of respective homopolymers calculated according to Fedors' method and respective homopolymerization Tg values (measured values) for styrene, methyl methacrylate, acrylonitrile, butyl acrylate, and ethyl acrylate. The homopolymerization Tg values are referred to for example in the following literature C.

Literature C: J. Brandrup, E. H. Immergut, and E. A. Grulke, "Polymer handbook", Fourth Edition, vol. 1, WILEY-INTERSIENCE, VI/199-VI/277, May 2003.

TABLE 1

| Homopolymer | Tg [° C.] | SP value [$(cal/cm^3)^{1/2}$] |
|---|---|---|
| Polystyrene | 100-105 | 9.2 |
| Polymethylmethacrylate | 105 | 10.7 |
| Polyacrylonitrile | 104 | 14.8 |
| Poly(butyl acrylate) | −54 | — |
| Poly(ethyl acrylate) | −20 | — |

Hereinafter, an SP value (temperature: 25° C.) calculated according to Fedors' method will be referred to simply as an SP value.

The toner having the above basic structure is excellent in high-temperature preservability and low-temperature fixability. A mechanism in operation and advantages of the basic structure that are is inferred will be described below.

The toner having the basic structure includes shell layers each containing the first and second domains that each include a common copolymer of at least one main monomer (monomer having a mole fraction of at least 20 mol %) and at least one additional monomer (monomer each having a mole fraction of less than 20 mol %). Even when a main monomer and an additional monomer are mixed together at a specific molar ratio for reaction in a situation in which domains (the first or second domains) are formed, a local increase or decrease in molar ratio tends to occur as the reaction proceeds. For the reason as above, non-homogenous domains in which for example the mole fraction of a specific monomer is high in a part may often be formed. It is considered as a reason thereof that reactivity and compatibility differ depending on a combination of monomers. In particular, resin synthesis by radical polymerization tends to cause a synthesized resin to have non-homogenous structure.

In a configuration in which domains have non-homogenous structure such as above, the domains are considered to have region in which a content of a main monomer is high (hereafter referred to as main regions) and regions in which a content of a low-Tg common monomer is high (hereinafter referred to as common regions). At a boundary between a first domain and a second domain, it is considered that: a main region of the first domain is in contact with a main region of the second domain; a common region of the first domain is in contact with a common region of the second domain; and a main region of the first or second domain is in contact with a common region of the second or first domain. Due to a difference in content among the monomers (mole fractions of respective copolymers), an area where main regions are in contact with each other is considered to be larger than an area where common regions are in contact with each other.

In the above basic structure, a difference in SP value between polymers (homopolymers or copolymers) of the main monomer (first main monomer) of the first domains and the main monomer (second main monomer) of the second domains is no less than 0.5. In the above configuration, bonding between the main regions is considered to be comparatively weak. However, the difference in polymer SP value between the main monomer of the first domains and the main monomer of the second domains is no greater than 5.0. In the above configuration, the shell layer is considered to have strength (stability) to a certain extent. By contrast, the common regions of the first and second domains are alike in property (have substantially the same SP value and the like). In the above configuration, the common regions are considered to bond together strongly. At a boundary between a first domain and a second domain, not only main regions bond together but also common regions bond together. Therefore, it is considered that sufficient high-temperature preservability of the toner can be ensured.

Furthermore, the first and second domains each include a low-Tg common monomer (monomer having a homopolymerization Tg of no greater than −20° C.) as an additional monomer. Contact areas among respective common regions of the first and second domains are comparatively small. In the above configuration, the common regions in contact with one another are considered to readily separate by heat and pressure in fixing the toner to a recording medium (for example, paper). Therefore, the toner having the above basic structure is considered to be excellent in low-temperature fixability.

In order to improve both high-temperature preservability and low-temperature fixability of the toner, the mole fraction of the low-Tg common monomer of the respective copolymers included in the first domain and the second domain are preferably at least 5 mol % and no greater than 20 mol %, and more preferably at least 5 mol % and no greater than 10 mol %. In addition, in order to improve both high-temperature preservability and low-temperature fixability of the toner, each homopolymerization Tg of the respective main monomers of the first and second domains is preferably 100° C. greater than the homopolymerization Tg of the low-Tg common monomer. In order to ensure sufficient ease of manufacture of the toner (for example, handleability toward a material and the like) without using special equipment or materials, the homopolymerization Tg of the low-Tg common monomer is preferably at least −60° C.

Figure 2:
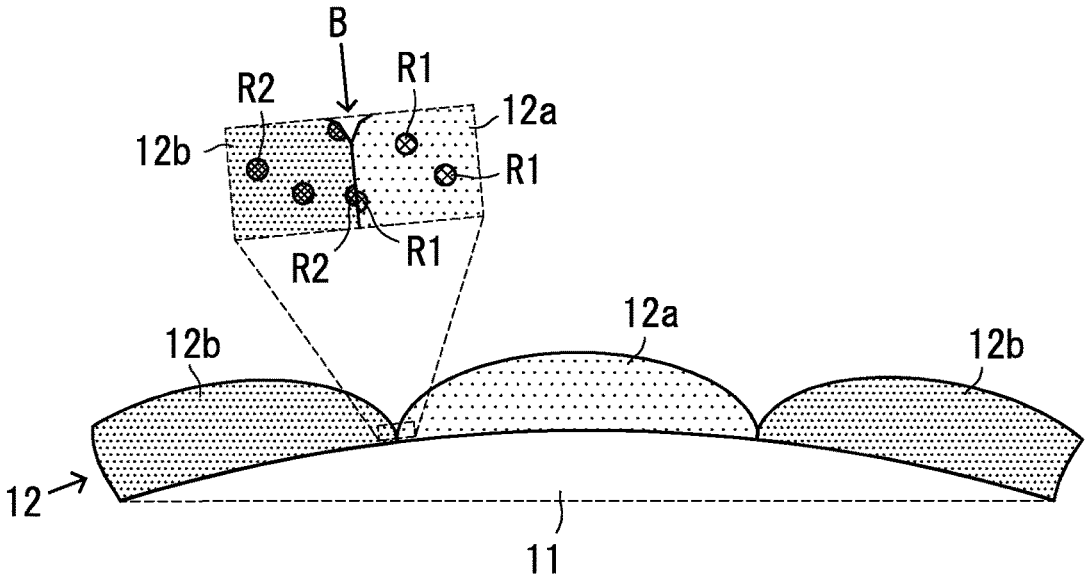
FIG. 2 is an enlarged view of a part of a surface of the toner mother particle illustrated in FIG. 1.

Following describes an example of the structure of the toner according to the present embodiment with reference to FIGS. 1 and 2. Note that FIG. 1 illustrates an example of structure of a toner particle (specifically, a toner mother particle) included in the toner according to the present embodiment. FIG. 2 is an enlarged view of a part of the toner mother particle illustrated in FIG. 1.

A toner mother particle 10 illustrated in FIG. 1 includes a toner core 11 and a shell layer 12 disposed over a surface of the toner core 11. The shell layer 12 is formed substantially from a resin. The shell layer 12 covers a surface region of the toner core 11. The shell layer 12 may entirely or partially cover the surface of the toner core 11.

As illustrated in FIG. 2, the shell layer 12 of the toner mother particle 10 has a plurality of first domains 12*a* (only one first domain 12*a* is illustrated in FIG. 2) and a plurality of second domains 12*b*. The first and second domains 12*a* and 12*b* each have a granular shape (specifically, a hemi-ellipsoidal shape). Respective parts (bottom parts) of the first and second domains 12*a* and 12*b* may each be embedded in the toner core 11.

The first domains 12*a* are each formed substantially from a copolymer of for example styrene having a mole fraction of 90 mol % and butyl acrylate having a mole fraction of 10 mol %. The second domains 12*b* are each formed substantially from a copolymer of for example methyl methacrylate having a mole fraction of 90 mol %, butyl acrylate having a mole fraction of 9 mol %, and 2-(methacryloyloxy)ethyl trimethylammonium chloride having a mole fraction of 1 mol %. The respective main monomers (monomers each having a mole fraction of at least 20 mol %) and the respective additional monomers (monomers each having a mole fraction of less than 20 mol %) of the first and second domains 12*a* and 12*b* as above are as follows. That is, the main monomer (first main monomer) of the first domains 12*a* is styrene, and the additional monomer (first additional monomer) of the first domains 12*a* is butyl acrylate. The main monomer (second main monomer) of the second domains 12*b* is methyl methacrylate, and the additional monomers (second additional monomer) of the second domains 12*b* are butyl acrylate and 2-(methacryloyloxy) ethyl trimethylammonium chloride. A difference in homopolymer SP value between styrene (the main monomer of the first domains 12*a*) and methyl methacrylate (the main monomer of the second domains 12*b*) is 1.5 (=|9.2−10.7|) (see Table 1). The first and second domains 12*a* and 12*b* each contain butyl acrylate as a low-Tg common monomer (see Table 1).

Referring to FIG. 2, common regions R1 of a first domain 12*a* and common regions R2 of a second domain 12*b* each indicate a region having a high content of the low-Tg common monomer (butyl acrylate). A boundary B indicates a boundary surface (contact part) between the first domain 12*a* and the second domain 12*b*. As illustrated in FIG. 2, a common region R1 of the first domain 12*a* is in contact with a common region R2 of the second domain 12*b* at the boundary B. However, at the boundary B, an area of a region where a region (also referred to below as a first main region) of the first domain 12*a* in which the content of the main monomer (first main monomer) is high is in contact with a region (also referred to below as a second main region) of the second domain 12*b* in which the content of the main monomer (second main monomer) is high is larger than an area of a region where the common region R1 is in contact with the common region R2.

A difference in homopolymer SP value between the first main monomer (styrene) and the second monomer (methyl methacrylate) is at least 0.5 and no greater than 5.0. In the above configuration, bonding between the first and second main regions is considered to be comparatively weak. By contrast, the common regions R1 and R2 are alike in property (have substantially the same SP value and the like). In the above configuration, the common regions R1 and R2 are considered to be bonded together strongly. It is considered that when the common regions R1 and R2 bond together strongly at a part of the boundary B, sufficient strength of the shell layer 12 (and sufficient high-temperature preservability of the toner) can be ensured.

Furthermore, the low-Tg common monomer (butyl acrylate) has a homopolymerization Tg of no greater than −20° C. The area at the boundary B where the common region R1 is in contact with the common region R2 is comparatively small. In the above configuration, the common region R1 becomes readily separate from the common region R2 by heat and pressure in fixing the toner to a recording medium. As such, the toner illustrated in FIG. 2 is considered to be excellent in low-temperature fixability.

As described as above, the electrostatic latent image developing toner having the above basic structure (toner according to the present embodiment) is excellent in high-temperature preservability and low-temperature fixability (see Tables 2-5 indicated later). The toner according to the present embodiment includes a plurality of toner particles defined in accordance with the above basic structure (hereinafter referred to as toner particles of the present embodiment). Note that the toner preferably includes the toner particles of the present embodiment at a rate of at least 80% by number, more preferably at least 90% by number, and further preferably 100% by number in order to improve both high-temperature preservability and low-temperature fixability of the toner. Toner particles including no shell layer may be included in the toner in addition to the toner particles of the present embodiment.

The shell layer preferably covers at least 50% and no greater than 99% of the surface region of the toner core, and more preferably at least 70% and no greater than 95% in order to improve both high-temperature preservability and low-temperature fixability of the toner. The shell layer preferably has a maximum thickness of at least 1 nm and no greater than 100 nm in order to improve both high-temperature preservability and low-temperature fixability of the toner.

The toner preferably has a volume median diameter ($D_{50}$) of at least 1 μm and less than 10 μm in order to improve both high-temperature preservability and low-temperature fixability of the toner.

Next, the toner core (a binder resin and an internal additive), the shell layer, and the external additive will be described in stated order. A component (for example, an internal additive or an external additive) that is not necessary may be omitted according to the purpose of the toner.

<Preferable Thermoplastic Resin>

Examples of thermoplastic resins that can be preferably used for forming the toner particles (particularly, the toner cores and the shell layers) include styrene-based resins, acrylic acid-based resins (specific examples include an acrylic acid ester polymer and a methacrylic acid ester polymer), olefin-based resins (specific examples include a polyethylene resin and a polypropylene resin), vinyl chloride resins, polyvinyl alcohol, vinyl ether resins, N-vinyl resins, polyester resins, polyamide resins, and urethane resins. A copolymer of any of the resins listed above, that is, a copolymer of any of the resins listed above into which an optional repeating unit is introduced (specific examples include a styrene-acrylic acid-based resin and a styrene-butadiene-based resin) is also preferably used.

A styrene-acrylic acid-based resin is a copolymer of at least one styrene-based monomer and at least one acrylic acid-based monomer. In a situation in which a styrene-acrylic acid-based resin is synthesized, any of styrene-based monomers and any of acrylic acid-based monomers that are listed below can for example be used favorably. Use of an acrylic acid-based monomer having a carboxyl group can result in introduction of the carboxyl group into a styrene-acrylic acid-based resin. Use of a monomer having a hydroxyl group (specific examples include p-hydroxystyrene, m-hydroxystyrene, and (meth)acrylic acid hydroxyalkyl ester) can result in introduction of the hydroxyl group into a styrene-acrylic acid-based resin. The acid value of a resultant styrene-acrylic acid-based resin can be adjusted through appropriate adjustment of the amount of the acrylic acid-based monomer to use. The hydroxyl value of the resultant styrene-acrylic acid-based resin can be adjusted through appropriate adjustment of the amount of the hydroxyl group-containing monomer to use.

Examples of preferable styrene-based monomers include styrene, α-methylstyrene, p-hydroxy styrene, m-hydroxy styrene, vinyltoluene, α-chlorostyrene, o-chlorostyrene, m-chlorostyrene, p-chlorostyrene, and p-ethylstyrene.

Examples of preferable acrylic acid-based monomers include (meth)acrylic acids, (meth)acrylic acid alkyl esters, and (meth)acrylic acid hydroxyalkyl esters. Examples of preferable (meth)acrylic acid alkyl esters include (meth) methyl acrylate, (meth)ethyl acrylate, (meth)n-propyl acrylate, (meth)iso-propyl acrylate, (meth)n-butyl acrylate, (meth)iso-butyl acrylate, and (meth)2-ethylhexyl acrylate. Examples of preferable (meth)acrylic acid hydroxyalkyl esters include (meth)acrylic acid2-hydroxyethyl, (meth) acrylic acid3-hydroxypropyl, (meth)acrylic acid2-hydroxypropyl, and (meth)acrylic acid4-hydroxybutyl.

A polyester resin can be yielded by condensation polymerization of at least one polyhydric alcohol and at least one polybasic carboxylic acid. Examples of alcohols that can be used for synthesis of a polyester resin include dihydric alcohols (specific examples include diols and bisphenols) and tri- or higher-hydric alcohols listed below. Examples of carboxylic acids that can be preferably used for synthesis of a polyester resin include dibasic carboxylic acids and tri- or higher-basic carboxylic acids listed below. The acid value and the hydroxyl value of a polyester resin can be adjusted through appropriate adjustment of the respective amounts of an alcohol and an carboxylic acid to use during synthesis of the polyester resin. Increasing the molecular weight of a polyester resin tends to decrease the acid value and the hydroxyl value of the polyester resin.

Examples of preferable diols include ethylene glycol, diethylene glycol, triethylene glycol, 1,2-propanediol, 1,3-propanediol, 1,4-butanediol, neopentyl glycol, 2-butene-1,4-diol, 1,5-pentanediol, 1,6-hexanediol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adducts, and bisphenol A propylene oxide adducts.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenylsuccinic acids (specific examples include n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

[Toner Core]

(Binder Resin)

The binder resin is typically a main component (for example, at least 85% by mass) of the toner cores. Properties of the binder resin are therefore expected to have great influence on an overall property of the toner cores. The toner cores have a strong tendency to be anionic when the binder resin has a group such as an ester group, a hydroxyl group, an ether group, an acid group, or a methyl group. By contrast, the toner cores have a strong tendency to be cationic when the binder resin has a group such as an amino group or an amide group. In order that the binder resin is strongly anionic, the hydroxyl value and the acid value of the binder resin each are preferably no less than 10 mgKOH/g.

The binder resin preferably has one or more groups selected from the group consisting of an ester group, a hydroxyl group, an ether group, an acid group, and a methyl group with either or both of a hydroxyl group and a carboxyl group being more preferable. The binder resin having such a functional group can readily react with the shell material to form chemical bonds. Such chemical bonding causes strong bonding between the toner cores and the shell layers. Furthermore, the binder resin preferably has an activated hydrogen-containing functional group in molecules thereof.

The binder resin preferably has a glass transition point (Tg) of at least 20° C. and no greater than 55° C. in order to improve fixability of the toner in high speed fixing. The binder resin preferably has a softening point (Tm) of no greater than 100° C. in order to improve fixability of the toner in high speed fixing. Note that respective methods for measuring Tg and Tm are the same as those described in Examples described later or alternative methods thereof. Changing the type or amount (blend ratio) of the components (monomers) of the resin can result in adjustment of either or both of Tg and Tm of the resin. A combination of plural types of resins can also result in adjustment of either or both of Tg and Tm of the binder resin.

The binder resin of the toner cores is preferably a thermoplastic resin (specific examples include "examples of preferable thermoplastic resins" listed above). A styrene-acrylic acid-based resin or a polyester resin is preferably used as the binder resin in order to improve dispersibility of a colorant in the toner core, chargeability of the toner, and fixability of the toner to a recording medium.

In a configuration in which a styrene-acrylic acid-based resin is used as the binder resin of the toner cores, the styrene-acrylic acid-based resin preferably has a number average molecular weight (Mn) of at least 2,000 and no greater than 3,000 in order to improve strength of the toner cores and fixability of the toner. The styrene-acrylic acid-based resin preferably has a molecular weight distribution (ratio Mw/Mn of mass average molecular weight (Mw) relative to number average molecular weight (Mn)) of at least 10 and no greater than 20.

In a configuration in which a polyester resin is used as the binder resin of the toner cores, the polyester resin preferably has a number average molecular weight (Mn) of at least 1,000 and no greater than 2,000 in order to improve strength of the toner cores and fixability of the toner. The polyester resin preferably has a molecular weight distribution (ratio Mw/Mn of mass average molecular weight (Mw) relative to number average molecular weight (Mn)) of at least 9 and no greater than 21.

(Colorant)

The toner cores may each contain a colorant. The colorant can be a known pigment or dye that matches the color of the toner. The amount of the colorant is preferably at least 1 part by mass and no greater than 20 parts by mass relative to 100 parts by mass of the binder resin in order to form a high-quality image using the toner.

The toner cores may contain a black colorant. Carbon black can for example be used as a black colorant. Alternatively, a colorant that is adjusted to a black color using a yellow colorant, a magenta colorant, and a cyan colorant can for example be used as a black colorant.

The toner cores may contain a non-black colorant such as a yellow colorant, a magenta colorant, or a cyan colorant.

One or more compounds selected from the group consisting of condensed azo compounds, isoindolinone compounds, anthraquinone compounds, azo metal complexes, methine compounds, and arylamide compounds can be used for example as a yellow colorant. Specific examples of yellow colorants that can be preferably used include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C. I. Vat Yellow.

One or more compounds selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used for example as a magenta colorant. Specific examples of magenta colorants that can be preferably used include C. I. Pigment Red (for example, 2, 3, 5, 6, 7, 19, 23, 48:2, 48:3, 48:4, 57:1, 81:1, 122, 144, 146, 150, 166, 169, 177, 184, 185, 202, 206, 220, 221, and 254).

One or more compounds selected from the group consisting of copper phthalocyanine compounds, anthraquinone compounds, and basic dye lake compounds can be used for example as a cyan colorant. Examples of cyan colorants that can be preferably used include C. I. Pigment Blue (1, 7, 15, 15:1, 15:2, 15:3, 15:4, 60, 62, and 66), Phthalocyanine Blue, C. I. Vat Blue, and C. I. Acid Blue.

(Releasing Agent)

The toner cores may each contain a releasing agent. The releasing agent is for example used in order to improve fixability of the toner or resistance of the toner to being offset. The toner cores are preferably produced using an anionic wax in order to increase anionic strength of the toner cores. The amount of the releasing agent is preferably at least 1 part by mass and no greater than 30 parts by mass relative to 100 parts by mass of the binder resin in order to improve fixability or offset resistance of the toner.

Examples of releasing agents that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a part or all of a fatty acid ester has been deoxidized such as deoxidized carnauba wax. One of the releasing agents listed above may be used, or a combination of two or more of the releasing agents listed above may be used.

A compatibilizer may be added to the toner cores in order to improve compatibility between the binder resin and the releasing agent.

(Charge Control Agent)

The toner cores may each contain a charge control agent. The charge control agent is for example used in order to improve charge stability or a charge rise characteristic of the toner. The charge rise characteristic of the toner is an indicator as to whether the toner can be charged to a specific charge level in a short period of time.

Containment of a negatively chargeable charge control agent (specific examples include an organic metal complex and a chelate compound) in the toner cores can increase anionic strength of the toner cores. By contrast, containment of a positively chargeable charge control agent (specific examples include pyridine, nigrosine, and quaternary ammonium salt) in the toner cores can increase cationic strength of the toner core. However, the toner cores need not to contain a charge control agent in a configuration in which sufficient chargeability of the toner can be ensured.

(Magnetic Powder)

The toner cores may each contain a magnetic powder. Examples of materials of the magnetic powder that can be preferably used include ferromagnetic metals (specific examples include iron, cobalt, nickel, and an alloy containing one or more of the listed metals), ferromagnetic metal oxides (specific examples include ferrite, magnetite, and chromium dioxide), and materials subjected to ferromagnetization (specific examples include carbon materials to which ferromagnetism is imparted through thermal treatment). One type of the magnetic powders listed above may be used, or a combination of two or more types of the magnetic powders listed above may be used.

The magnetic powder is preferably subjected to surface treatment in order to inhibit elution of metal ions (e.g., iron ions) from the magnetic powder. In a situation in which the shell layers are formed over the surfaces of the toner cores under acidic conditions, elution of metal ions to the surfaces of the toner cores may cause the toner cores to adhere to one another more readily. It is considered that inhibition of elution of metal ions from the magnetic powder can inhibit toner cores from adhering to one another.

[Shell Layer]

The toner according to the present embodiment has the above basic structure. The first and second domains of the shell layer each include a copolymer of at least one main monomer and at least one additional monomer. The first and second domains each include a low-Tg common monomer (monomer having a homopolymerization Tg of no greater than −20° C.) as an additional monomer.

In order that the toner has the above basic structure, the main monomers of the first domains, the main monomers of the second domains, and the common monomer each are a radical polymerizable unsaturated monomer. Synthesis of a resin through radical polymerization can easily form non-homogenous structure (for example, presence of the common regions R1 and R2 illustrated in FIG. 2) as described above in the resin. Examples of preferable radical polymerizable unsaturated monomers include vinyl compounds. A vinyl compound is a compound having a vinyl group ($CH_2{=}CH{-}$) or a vinyl group in which hydrogen is substituted. Examples of possible vinyl compounds include ethylene, propylene, butadiene, vinyl chloride, acrylic acid, acrylic acid ester, methacrylic acid, methacrylic acid ester, acrylonitrile, styrene, and (meth)acryloyl group-containing quaternary ammonium compounds listed below. Examples of preferable vinyl group ($CH_2{=}CH{-}$)-containing monomers include styrene and acrylic acid ester. Examples of preferable methacryloyl group ($CH_2{=}C(CH_3){-}CO{-}$)-containing monomers include methacrylic acid ester. A repeating unit derived from a vinyl compound in the resin is considered to be addition polymerized through carbon double bonding "C=C".

In order to improve both high-temperature storage resistance and low-temperature fixability of the toner, preferably, the main monomers of the first and second domains each are, independently of one another, at least one monomer selected from the group consisting of styrene, methyl methacrylate, and acrylonitrile. Furthermore, the low-Tg common monomer preferably includes either or both of ethyl acrylate and butyl acrylate in order to improve both high-temperature preservability and low-temperature fixability of the toner.

Only the second domains among the first and second domains preferably contain a charge control agent in order to impart appropriate chargeability to the toner particles. In order that the second domains each contain a charge control agent, a repeating unit derived from the charge control agent may be introduced into a resin forming the second domains or chargeable particles may be dispersed in a resin forming the second domains. However, in order to obtain a toner excellent in chargeability, high-temperature preservability, and low-temperature fixability, it is preferable that the copolymer forming the first domains has no repeating unit derived from the charge control agent and the copolymer forming the second domains has a repeating unit derived from the charge control agent. The copolymer forming the second domains particularly preferably has a repeating unit derived from a (meth)acryloyl group-containing quaternary ammonium compound as a repeating unit derived from a charge control agent. Specifically, the copolymer forming the second domains preferably has a repeating unit represented by the following formula (1) or a salt thereof. Examples of (meth)acryloyl group-containing quaternary ammonium compounds that can be preferably used include methacryloyloxy alkyl trimethyl ammonium salts (specific examples include 2-(methacryloyloxy)ethyl trimethylammonium chloride).

(1)

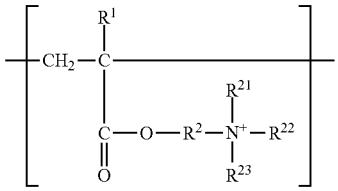

In formula (1), $R^1$ represents a hydrogen atom or a methyl group and $R^{21}$, $R^{22}$, and $R^{23}$ represent, independently of one another, a hydrogen atom, an optionally substituted alkyl group, or an optionally substituted alkoxy group. Further, $R^2$ represents an optionally substituted alkylene group. Preferably, $R^{21}$, $R^{22}$, and $R^{23}$ represent, independently of one another, an alkyl group having a carbon number of at least 1 and no greater than 8, and more preferably a methyl group, an ethyl group, an n-propyl group, an iso-propyl group, an n-butyl group, or an iso-butyl group. Preferably, $R^2$ represents an alkylene group having a carbon number of at least 1 and no greater than 6, and more preferably a methylene group or an ethylene group. In the repeating unit derived from 2-(methacryloyloxy)ethyl trimethylammonium chloride: $R^1$ represents a methyl group: $R^2$ represents an ethylene group; $R^{21}$ to $R^{23}$ each represent a methyl group; and quaternary ammonium cation ($N^+$) is ionically bonded to chlorine (Cl) to form a salt.

A first preferable example of the shell layer is a shell layer in which: the first copolymer included in the first domains contains styrene as a first main monomer; the second copolymer included in the second domains contains methacrylic acid alkyl ester as a second main monomer; and the first and second copolymers each contain ethyl acrylate or butyl acrylate as a common monomer.

A second preferable example of the shell layer is a shell layer in which: the first copolymer included in the first domains contains styrene and methacrylic acid alkyl ester as first main monomers; the second copolymer included in the second domains contains styrene as a second main monomer; and the first and second copolymers each contain ethyl acrylate or butyl acrylate as a common monomer.

A third preferable example of the shell layer is a shell layer in which: the first copolymer included in the first domains contains acrylonitrile as a first main monomer; the second copolymer included in the second domains contains methacrylic acid alkyl ester as a second main monomer; and the first and second copolymers each contain ethyl acrylate or butyl acrylate as a common monomer.

[External Additive]

Inorganic particles may be attached to surfaces of the toner mother particles as an external additive. When the toner mother particles (powder) and the external additive (powder of inorganic particles) are stirred together, parts (bottom parts) of the inorganic particles are embedded in surface layer portions of the toner mother particles such that the inorganic particles are attached to the surfaces of the toner mother particles by a physical power (physical bond). The external additive is used for example to improve fluidity or handling property of the toner. The amount of the external additive is preferably at least 0.5 parts by mass and no greater than 10 parts by mass relative to 100 parts by mass of the toner mother particles in order to improve fluidity or handling property of the toner. In order to improve fluidity or handling property of the toner, the external additive preferably has a particle diameter of at least 0.01 μm and no greater than 1.0 μm.

Examples of external additive particles (inorganic particles) that can be preferably used include silica particles and particles of metal oxides (specific examples include alumina, titanium oxide, magnesium oxide, zinc oxide, strontium titanate, and barium titanate). One type of external additive particles may be used, or a combination of two or more types of external additive particles may be used.

[Toner Production Method]

Following describes an example of a method for producing the toner according to the present embodiment that has the above basic structure. First of all, toner cores are prepared. Subsequently, the toner cores and a shell material are added to a liquid. It is preferable to dissolve or disperse the shell material in the liquid by for example stirring the liquid including the shell material in order to form a uniform shell layer. Then, the shell material is caused to react in the liquid to form shell layers (hardened resin layers) on the surfaces of the toner cores. In order to inhibit dissolution or elution of toner core components (particularly, a binder resin and a releasing agent) during formation of the shell layers, the formation of the shell layers is preferably carried out in an aqueous medium. The aqueous medium is a medium of which main component is water (specific examples include pure water and a mixed liquid of water and a polar medium). The aqueous medium may function as a solvent. A solute may be dissolved in the aqueous medium. The aqueous medium may function as a dispersion medium. A dispersoid may be dispersed in the aqueous medium. Examples of polar mediums in the aqueous medium that can be used include alcohols (specific examples include methanol and ethanol).

Following describes a method for producing the toner according to the present embodiment by referring to a more specific example.

(Preparation of Toner Cores)

In order to easily obtain preferable toner cores, the toner cores are preferably produced according to an aggregation method or a pulverization method and more preferably according to the pulverization method.

An example of the pulverization method will be described below. First, a binder resin and an internal additive (for example, at least one of a colorant, a releasing agent, a charge control agent, and a magnetic powder) are mixed together. Subsequently, the resultant mixture is melt-knead. The resultant melt-knead substance is pulverized and classified. Through the above, toner cores having a desired particle diameter can be obtained.

An example of the aggregation method will be described below. First, binder resin particles, releasing agent particles, and colorant particles are aggregated until the particles each have a desired particle diameter in an aqueous medium including the respective particles. As a result, aggregated particles of the binder resin, the releasing agent, and the colorant are formed. Subsequently, the resultant aggregated particles are heated for coalescence of the components contained in the aggregated particles. As a result, a dispersion of the toner cores is obtained. Thereafter, unnecessary substances (a surfactant and the like) are removed from the dispersion of the toner cores to obtain toner cores.

(Formation of Shell Layer)

An aqueous medium (for example, ion exchanged water) is prepared as the liquid to which the toner cores and the shell material are added. Subsequently, the pH of the aqueous medium is adjusted to a specific pH (for example, 4) using for example hydrochloric acid. Then, the toner cores, a suspension of the first resin particles, and a suspension of the second resin particles are added to the aqueous medium of which pH has been adjusted (for example, an acid aqueous medium). The first and second resin particles are each formed substantially from a copolymer. A combination of the first and second copolymers are selected so as to meet the prerequisites defined for the above basic structure.

The toner cores and the shell material may be added to the aqueous medium at room temperature or the aqueous medium of which temperature is adjusted (kept) at a specific temperature. An appropriate amount of the shell material to be added can be calculated based on the specific surface area of the toner cores. Further, a polymerization accelerator may be added to the aqueous medium in addition to the toner cores and the like.

The first and second resin particles are attached to the surfaces of the toner cores in the liquid. Preferably, the toner cores are highly dispersed in the liquid including the first and second resin particles in order to uniformly attach the first and second resin particles to the surfaces of the toner cores. In order to highly disperse the toner cores in the liquid, the liquid may contain a surfactant or be stirred using a high-power stirrer (for example, "Hivis Disper Mix" produced by PRIMIX Corporation). In a configuration in which the toner cores are anionic, agglomeration of the toner cores can be inhibited by using an anionic surfactant that has the same polarity as that of the toner cores. Examples of surfactants that can be used include sulfate ester salts, sulfonic acid salts, phosphate ester salts, and soap.

Subsequently, the temperature of the liquid including the toner cores and the first and second resin particles is increased to a specific retention temperature (for example, a temperature of at least 50° C. and no greater than 85° C.) at a specific speed (for example, a speed of at least 0.1° C./min. and no greater than 3° C./min.) while the liquid is stirred. Furthermore, the temperature of the liquid is kept at the retention temperature for a specific period of time (for example, at least 30 minutes and no greater than four hours) while the liquid is stirred. During the liquid being kept at high temperature (or during temperature increase), the first and second resin particles are attached to the surfaces of the toner cores and react with the toner cores. When the first and second resin particles bond to the toner cores, shell layers are formed. Changing the retention temperature and the retention time period can result in adjustment of a film property of the shell layer (for example, an aspect of the boundary B between the first and second domains 12*a* and 12*b* as illustrated in FIG. 2). Formation of the shell layers on the surfaces of the toner cores in the liquid results in production of a dispersion of toner mother particles.

After formation of the shell layers as above, the dispersion of the toner mother particles is cooled to for example normal temperature (approximately 25° C.). The dispersion of the toner mother particles are then filtered using for example a Buchner funnel. Filtration of the dispersion of the toner mother particles separates the toner mother particles from the liquid (solid-liquid separation), thereby collecting a wet cake of the toner mother particles. Next, the resultant wet cake of the toner mother particles is washed. The toner mother particles that have been washed are then dried. Thereafter, as necessary, the toner mother particles may be mixed with an external additive using a mixer (for example, an FM mixer produced by Nippon Coke & Engineering Co., Ltd.) to attach the external additive to the surfaces of the toner mother particles. Through the above, a toner including multiple toner particles is produced.

Note that processes and order of the method for producing the toner described above may be changed freely in accordance with desired structure, characteristics, and the like of the toner. For example, in a situation in which a material (for example, the shell material) is caused to react in the liquid, the material may be caused to react in the liquid for a specific time period after addition of the material to the liquid. Alternatively, the material may be caused to react in the liquid while being added to the liquid over a long period of time. Further, the shell material may be added to the liquid at once or plural times. The toner may be sifted after external addition. Also, non-essential processes may alternatively be omitted. For example, in a method in which a commercially available product can be used directly as a material, use of the commercially available product can omit the process of preparing the material. In a method in which reaction for forming the shell layers progresses favorably even without pH adjustment of the liquid, the process of pH adjustment may be omitted. In a method in which no external additive is necessary, the external addition process may be omitted. In a method in which an external additive is not attached to the surfaces of the toner mother particles (i.e., a method in which the external addition process is omitted), the toner mother particles are equivalent to the toner particles. A prepolymer may be used instead of a monomer as a material for resin synthesis depending on necessity. In order to yield a specific compound, a salt, ester, hydrate, or anhydride of the compound may be used as a raw material. Preferably, a large number of the toner particles are formed at the same time in order to produce the toner efficiently. The toner particles produced at the same time are considered to have substantially the same configuration.

Examples

Following describes examples of the present disclosure. Table 2 indicates toners TA-1 to TA-3, TB-1 to TB-3, TC, TD, and TE (each are an electrostatic latent image developing toner) according to the examples and comparative examples. Tables 3 and 4 indicate shell materials ("Shell material" in Table 2) used in production of the respective toners.

TABLE 2

| | Shell material | | Low-Tg | Difference in SP |
|---|---|---|---|---|
| Toner | First (main monomer) | Second (main monomer) | common monomer (Tg: ≤−20° C.) | value between main monomers [(cal/cm$^3$)$^{1/2}$] |
| TA-1 | A-1 (ST) | B-1 (MMA) | BA | 1.5 (=10.7 − 9.2) |
| TA-2 | A-1 (ST) | B-2 (ST) | BA | 0.0 (=9.2 − 9.2) |
| TA-3 | A-1 (ST) | B-3 (MMA) | None | 1.5 (=10.7 − 9.2) |
| TB-1 | A-2 (ST, MMA) | B-2 (ST) | BA | 1.0 (=10.2 − 9.2) |
| TB-2 | A-5 | B-2 | BA | 5.6 (=14.8 − 9.2) |

TABLE 2-continued

| Toner | Shell material First (main monomer) | Shell material Second (main monomer) | Low-Tg common monomer (Tg: ≤−20° C.) | Difference in SP value between main monomers [(cal/cm$^3$)$^{1/2}$] |
|---|---|---|---|---|
| | (AN) | (ST) | | |
| TB-3 | A-6 (ST, MMA) | B-2 (ST) | BA | 0.5 (=9.7 − 9.2) |
| TC | A-3 (MMA, AN) | B-1 (MMA) | BA | 2.0 (=12.7 − 10.7) |
| TD | A-4 (AN) | B-3 (MMA) | EA | 4.1 (=14.8 − 10.7) |
| TE | A-2 (ST, MMA) | B-4 (ST, MMA) | BA | 0.5 (=10.2 − 9.7) |

TABLE 3

| First shell material | Main monomer [g] (Mole fraction: [mol %]) ST | MMA | AN | Additional monomer [g] (Mole fraction: [mol %]) BA | EA | SP value [(cal/cm$^3$)$^{1/2}$] |
|---|---|---|---|---|---|---|
| A-1 | 18.0 (91.7) | — | — | 2.0 (8.3) | — | 9.2 |
| A-2 | 6.0 (29.8) | 12.0 (62.1) | — | 2.0 (8.1) | — | 10.2 |
| A-3 | — | 10.0 (37.5) | 8.0 (56.6) | 2.0 (5.9) | — | 12.7 |
| A-4 | — | — | 17.0 (91.4) | — | 3.0 (8.6) | 14.8 |
| A-5 | — | — | 18.0 (95.6) | 2.0 (4.4) | — | 14.8 |
| A-6 | 11.8 (59.4) | 6.2 (32.4) | — | 2.0 (8.2) | — | 9.7 |

TABLE 4

| Second shell material | Main monomer [g] (Mole fraction: [mol %]) ST | MMA | Additional monomer [g] (Mole fraction: [mol %]) BA | EA | QDM | SP value [(cal/cm$^3$)$^{1/2}$] |
|---|---|---|---|---|---|---|
| B-1 | — | 145 (90.8) | 17 (8.3) | — | 3 (0.9) | 10.7 |
| B-2 | 145 (90.5) | — | 17 (8.6) | — | 3 (0.9) | 9.2 |
| B-3 | — | 138 (84.4) | — | 24 (14.7) | 3 (0.9) | 10.7 |
| B-4 | 100 (61.7) | 45 (28.9) | 17 (8.5) | — | 3 (0.9) | 9.7 |

In Tables 2-4, "ST", "MMA", "AN", "BA", "EA", and "QDM" represent styrene (molecular weight: 104), methyl methacrylate (molecular weight: 100), acrylonitrile (molecular weight: 53), butyl acrylate (molecular weight: 128), ethyl acrylate (molecular weight: 100), and 2-(methacryloyloxy)ethyl trimethylammonium chloride (molecular weight: 208), respectively.

In Tables 2-4, "Main monomer" represents a monomer having a mole fraction of at least 20 mol %. In Tables 3-4, "Additional monomer" represents a monomer having a mole fraction of less than 20 mol %. For example, styrene (ST) accounts for 91.7 mol % (≃=100×0.1731/0.1887) and butyl acrylate (BA) accounts for 8.3 mol % (≃100×0.0156/0.1887) of 0.1887 moles of all the monomers (0.1731+0.0156 ≃18/104+2/128) in a suspension A-1 (first shell material). In the above configuration, styrene (ST) is a main monomer and butyl acrylate (BA) is an additional monomer in the suspension A-1 (first shell material). In Tables 3 and 4, parenthesized values each indicate a mole fraction (unit: mol %) of a corresponding monomer. The mole fraction of each monomer corresponds to a mole fraction of a repeating unit (a repeating unit derived from a corresponding monomer) in a polymer.

Values in "SP value (unit: (cal/cm$^3$)$^{1/2}$)" of Tables 3 and 4 are each calculated according to Fedors' method for a polymer (homopolymer or copolymer) of a corresponding main monomer. Values in "Difference in SP value between main monomers" of Table 2 each indicate a difference (absolute value) between the SP value of a polymer of the main monomer of a corresponding first shell material (see Table 3) and the SP value of a polymer of the main monomer of a corresponding second shell material (see Table 4). In Table 2, "Low-Tg common monomer" indicates monomers that each are a monomer of the same species included in common in corresponding first and second shell materials (except a corresponding main monomer) and that each have a glass transition point (see Table 1) of no greater than −20° C. in a situation in which the monomer becomes a homopolymer.

Following describes methods for producing the respective toners TA-1 to TE, evaluation methods, and evaluation results in stated order. In evaluations in which errors may occur, an evaluation value was calculated by calculating the arithmetic mean of an appropriate number of measured values in order to ensure that any errors were sufficiently small. Unless otherwise stated, the number average particle diameter of a powder is a number average value of equivalent circular diameters of primary particles measured using a transmission electron microscope (TEM). Respective methods for measuring Tg (glass transition point) and Tm (softening point) are those described below unless otherwise stated.

<Tg Measuring Method>

A heat absorption curve (vertical axis: heat flow (DSC signals), horizontal axis: temperature) of a sample (for example, a resin) was plotted using a differential scanning calorimeter (for example, "DSC-6200" produced by Seiko Instruments Inc.). Tg (glass transition point) of the sample was then read from the heat absorption curve that was plotted. Tg (glass transition point) of the sample corresponds to a temperature at a point of change (intersection between an extrapolation line of a base line and an extrapolation line of a fall line) in the specific heat on the heat absorption curve.

<Tm Measuring Method>

A sample (for example, a resin) was placed in a capillary rheometer ("CFT-500D" produced by Shimadzu Corporation), and melt-flow of 1 cm$^3$ of the sample was caused using a die diameter of 1 mm, a plunger load of 20 kg/cm$^2$, and a heating rate of 6° C./min. in order to plot an S-shaped curve (horizontal axis: temperature, vertical axis: stroke). Then, Tm of the sample was read from the S-shaped curve that was plotted. Tm (softening point) of the sample is a temperature on the S-shaped curve corresponding to a stroke value of $(S_1+S_2)/2$ where $S_1$ represents a maximum value of the stroke and $S_2$ represents a base-line stroke value at low-temperature.

[Methods for Producing Toner TA-1]

(Preparation of Toner Cores)

An FM mixer ("FM-20B" produced by Nippon Coke & Engineering Co., Ltd.) was used to mix 750 g of a low-viscosity polyester resin (Tg: 38° C., Tm: 65° C.), 100 g of an intermediate-viscosity polyester resin (Tg: 53° C., Tm: 84° C.), 150 g of a high-viscosity polyester resin (Tg: 71° C., Tm: 120° C.), 55 g of a releasing agent ("Carnauba Wax No. 1" produced by S. Kato & Co.), and 40 g of a colorant ("KET Blue 111" produced by DIC Corporation, component: Phthalocyanine Blue) at a rotational speed of 2,400 rpm. An increase in ratio of a low-viscosity polyester resin in a binder resin (polyester resin) can reduce melt viscosity of the binder resin.

Subsequently, a resultant mixture was melt-knead using a two screw extruder ("PCM-30" produced by Ikegai Corp.) under conditions of a material addition rate of 5 kg/hour, a shaft rotation speed of 160 rpm, and a temperature range (cylinder temperature) from at least 100° C. to no greater than 130° C. The resultant melt-knead product was then cooled.

Next, the melt-knead product was coarsely pulverized using a mechanical pulverizer ("Rotoplex (registered Japanese trademark)" produced by Hosokawa Micron Corporation). The resultant coarsely pulverized product was finely pulverized using a jet mill ("Model-I Super Sonic Jet Mill" produced by Nippon Pneumatic Mfg. Co., Ltd.). The resultant finely pulverized product was then classified using a classifier ("ELBOW-JET Model EJ-LABO" produced by Nittetsu Mining Co., Ltd.) to obtain toner cores having a volume median diameter ($D_{50}$) of 6 μm.

(Preparation of Suspension A-1)

A 1-L three-necked flask equipped with a thermometer and a stirring impeller was set in a water bath at a temperature of 30° C., and 875 mL of ion exchanged water and 75 mL of an anionic surfactant ("LATEMUL (registered Japanese trademark) WX" produced by Kao Corporation, component: polyoxyethylene alkyl ether sodium sulfate, solid concentration: 26% by mass) were added to the flask. Next, the internal temperature of the flask was increased to 80° C. using the water bath. Subsequently, two liquids (a first liquid and a second liquid) were each dripped into the flask contents at a temperature of 80° C. over five hours. The first liquid was a mixed liquid of 18 g of styrene and 2 g of butyl acrylate. The second liquid was a solution in which 0.5 g of potassium peroxodisulfate was dissolved in 30 mL of ion exchanged water. Then, the flask contents were polymerized in a state in which the internal temperature of the flask was kept at 80° C. for two hours. As a result, a suspension A-1 of a hydrophobic resin (specifically, a styrene-acrylic acid-based resin) was yielded. The resin particulates included in the yielded suspension A-1 had a number average particle diameter of 32 nm and a glass transition point (Tg) of 71° C.

(Preparation of Suspension B-1)

A 1-L three-necked flask equipped with a thermometer, a cooling pipe, a nitrogen inlet tube, and a stirring impeller was charged with 90 g of isobutanol, 145 g of methyl methacrylate, 17 g of butyl acrylate, 3 g of 2-(methacryloyloxy)ethyl trimethylammonium chloride (product of Alfa Aesar), and 6 g of 2,2'-azobis(2-methyl-N-(2-hydroxyethyl) propionamide) ("VA-086" produced by Wako Pure Chemical Industries, Ltd.). Subsequently, the flask contents were caused to react for three hours in a nitrogen atmosphere at a temperature of 80° C. Thereafter, 3 g of 2,2'-azobis(2-methyl-N-(2-hydroxyethyl)propionamide) ("VA-086" produced by Wako Pure Chemical Industries, Ltd.) was added to the flask contents to cause reaction of the flask contents for additional three hours in a nitrogen atmosphere at a temperature of 80° C., thereby obtaining a liquid including a polymer. The obtained liquid including the polymer was subsequently dried in a reduced-pressure atmosphere at a temperature of 150° C. The dried polymer was then broken up to yield a positively chargeable resin.

Subsequently, 200 g of the positively chargeable resin yielded as above and 184 mL of ethyl acetate ("special grade" produced by Wako Pure Chemical Industries, Ltd.) were added to a vessel of a mixer ("HIVIS MIX (registered Japanese trademark) Model 2P-1" produced by PRIMIX Corporation). Then, the vessel contents were stirred for one hour at a rotational speed of 20 rpm using the mixer to yield a high-viscosity solution. Thereafter, 20 g of an aqueous solution of ethyl acetate and the like (specifically, an aqueous solution in which 18 mL of 1N-hydrochloric acid, 20 g of an anionic surfactant ("Emal (registered Japanese trademark) 0" produced by Kao Corporation, component: sodium lauryl sulfate), and 16 g of ethyl acetate ("special grade" produced by Wako Pure Chemical Industries, Ltd.) was dissolved in 562 g of ion exchanged water) was added to the yielded high-viscosity solution. As a result, a suspension B-1 of a positively chargeable resin (specifically, an acrylic acid-based resin having a repeating unit derived from 2-(methacryloyloxy)ethyl trimethylammonium chloride) was yielded. The resin particulates included in the yielded suspension B-1 had a number average particle diameter of 38 nm and a glass transition point (Tg) of 77° C.

(Formation of Shell Layer)

A 1-L three-necked flask equipped with a thermometer and a stirring impeller was prepared, and the flask was set in a water bath. Subsequently, 100 mL of ion exchanged water was added to the flask and the internal temperature of the flask was kept at 30° C. using the water bath. The pH of the aqueous medium in the flask was then adjusted to pH 4 through addition of dilute hydrochloric acid to the flask.

Subsequently, 220 mL of a first shell material (suspension A-1 yielded as described above), 12 mL of a second shell material (suspension B-1 yielded as described above), and 300 g of toner cores (toner cores produced as described above) were added to the flask. The flask contents were then stirred at a rotational speed of 200 rpm for one hour. Thereafter, 300 mL of ion exchanged water was added to the flask.

Subsequently, the internal temperature of the flask was increased to 70° C. at a heating rate of 1° C./min. using a water bath, while the flask contents were stirred at a rotational speed of 100 rpm. The internal temperature of the flask was then kept at 70° C. for two hours, while the flask contents were stirred at a rotational speed of 100 rpm. Keeping the internal temperature of the flask at high temperature (70° C.) resulted in formation of shell layers on the surfaces of the toner cores. As a result, a dispersion including toner mother particles was obtained. The pH of the dispersion of the toner mother particles was adjusted to pH 7 (neutralization) using sodium hydroxide, and the dispersion of the toner mother particles was then cooled to normal temperature (approximately 25° C.).

(Washing)

Filtration (solid-liquid separation) of the dispersion of the toner mother particles obtained as above was performed using a Buchner funnel, thereby collecting a wet cake of the toner mother particles. The toner mother particles in the resultant wet cake were re-dispersed in ion exchanged water. Dispersion and filtration were further repeated five times in order to wash the toner mother particles.

(Drying)

Next, the resultant toner mother particles were dispersed in an aqueous ethanol solution having a concentration of 50% by mass. The dispersion of the toner mother particles yielded a slurry of the toner mother particles. The toner mother particles in the slurry were then dried under conditions of a hot air temperature of 45° C. and a flow rate of 2

$m^3$/min. using a continuous surface-modifying apparatus ("Coatmizer (registered Japanese trademark)" produced by Freund Corporation). As a result, toner mother particles (powder) were obtained. The surfaces of the toner mother particles were observed using a scanning electron microscope (SEM) ("JSM-6700F" produced by JEOL Ltd.) to confirmed that granular first domains and granular second domains were integrate to form film-shaped shell layers. In the film-shaped shell layer, the first domains were connected to (do not separate from) the second domains while granular appearance originated from the first and second domains was observed.

(External Addition)

External addition was performed on the toner mother particles after the drying as described above. Specifically, 100 parts by mass of the toner mother particles and 1 part by mass of dry silica particles ("AEROSIL (registered Japanese trademark) REA90" produced by Nippon Aerosil Co., Ltd.) were mixed together for five minutes using an FM mixer ("FM-20B" produced by Nippon Coke & Engineering Co., Ltd.) to attach an external additive (silica particles) to the surfaces of the toner mother particles. Thereafter, the resultant powder was sifted using a 200 mesh sieve (opening 75 μm). As a result, a toner TA-1 including multiple toner particles TA-1 was produced.

[Methods for Producing Toner TA-2]

The toner TA-2 was produced according to the same method as for the toner TA-1 in all aspects other than that a suspension B-2 was used instead of the suspension B-1 as a second shell material (see Table 2).

(Preparation of Suspension B-2)

The suspension B-2 was yielded according to the same method as for the suspension B-1 in all aspects other than that 145 g of styrene was used instead of 145 g of methyl methacrylate (see Table 4). Resin particulates included in the yielded suspension B-2 had a number average particle diameter of 39 nm and a glass transition point (Tg) of 80° C.

[Methods for Producing Toner TA-3]

The toner TA-3 was produced according to the same method as for the toner TA-1 in all aspects other than that a suspension B-3 was used instead of the suspension B-1 as a second shell material (see Table 2).

(Preparation of Suspension B-3)

The suspension B-3 was yielded according to the same method as for the suspension B-1 in all aspects other than that the amount of methyl methacrylate was changed from 145 g to 138 g and 24 g of ethyl acrylate was used instead of 17 g of butyl acrylate (see Table 4). Resin particulates included in the yielded suspension B-3 had a number average particle diameter of 40 nm and a glass transition point (Tg) of 79° C.

[Methods for Producing Toner TB-1]

The toner TB-1 was produced according to the same method as for the toner TA-2 in all aspects other than that a suspension A-2 was used instead of the suspension A-1 as a first shell material (see Table 2).

(Preparation of Suspension A-2)

The suspension A-2 was yielded according to the same method as for the suspension A-1 in all aspects other than that 6 g of styrene and 12 g of methyl methacrylate were used instead of 18 g of styrene (see Table 3). Resin particulates included in the yielded suspension A-2 had a number average particle diameter of 33 nm and a glass transition point (Tg) of 69° C.

[Methods for Producing Toner TB-2]

The toner TB-2 was produced according to the same method as for the toner TA-2 in all aspects other than that a suspension A-5 was used instead of the suspension A-1 as a first shell material (see Table 2).

(Preparation of Suspension A-5)

The suspension A-5 was yielded according to the same method as for the suspension A-1 in all aspects other than that 18 g of acrylonitrile was used instead of 18 g of styrene (see Table 3). Resin particulates included in the yielded suspension A-5 had a number average particle diameter of 40 nm and a glass transition point (Tg) of 68° C.

[Methods for Producing Toner TB-3]

The toner TB-3 was produced according to the same method as for the toner TA-2 in all aspects other than that a suspension A-6 was used instead of the suspension A-1 as a first shell material (see Table 2).

(Preparation of Suspension A-6)

The suspension A-6 was yielded according to the same method as for the suspension A-1 in all aspects other than that 11.8 g of styrene and 6.2 g of methyl methacrylate were used instead of 18 g of styrene (see Table 3). Resin particulates included in the yielded suspension A-6 had a number average particle diameter of 35 nm and a glass transition point (Tg) of 70° C.

[Methods for Producing Toner TC]

The toner TC was produced according to the same method as for the toner TA-1 in all aspects other than that a suspension A-3 was used instead of the suspension A-1 as a first shell material (see Table 2).

(Preparation of Suspension A-3)

The suspension A-3 was yielded according to the same method as for the suspension A-1 in all aspects other than that 10 g of methyl methacrylate and 8 g of acrylonitrile were used instead of 18 g of styrene (see Table 3). Resin particulates included in the yielded suspension A-3 had a number average particle diameter of 40 nm and a glass transition point (Tg) of 70° C.

[Methods for Producing Toner TD]

The toner TD was produced according to the same method as for the toner TA-3 in all aspects other than that a suspension A-4 was used instead of the suspension A-1 as a first shell material (see Table 2).

(Preparation of Suspension A-4)

The suspension A-4 was yielded according to the same method as for the suspension A-1 in all aspects other than that 17 g of acrylonitrile was used instead of 18 g of styrene and 3 g of ethyl acrylate was used instead of 2 g of butyl acrylate (see Table 3). Resin particulates included in the yielded suspension A-4 had a number average particle diameter of 43 nm and a glass transition point (Tg) of 70° C.

[Methods for Producing Toner TE]

The toner TE was produced according to the same method as for the toner TB-1 in all aspects other than that a suspension B-4 was used instead of the suspension B-2 as a second shell material (see Table 2).

(Preparation of Suspension B-4)

The suspension B-4 was yielded according to the same method as for the suspension B-1 in all aspects other than that 100 g of styrene and 45 g of methyl methacrylate were used instead of 145 g of methyl methacrylate (see Table 4). Resin particulates included in the yielded suspension B-4 had a number average particle diameter of 40 nm and a glass transition point (Tg) of 79° C.

[Evaluation Methods]

Samples (toners TA-1 to TE) each were evaluated according to the following evaluation methods.

(High-Temperature Preservability)

A 20-mL polyethylene vessel was charged with 2 g of each sample (toner), sealed, and was left to stand for three hours in a constant temperature bath set at a temperature of 60° C. The toner taken out from the constant temperature bath was then cooled to room temperature (approximately 25° C.), thereby obtaining an evaluation toner.

The resultant evaluation toner was placed on a 100-mesh sieve (opening: 150 μm) having a known mass. The mass of the toner prior to sifting was calculated by measuring the total mass of the sieve and the evaluation toner thereon. Next, the sieve was placed in a powder tester (product of Hosokawa Micron Corporation) and the evaluation toner was sifted in accordance with a manual of the powder tester by shaking the sieve for 30 seconds at a rheostat level of 5. The mass of the sieve including the toner after sifting was measured to calculate the mass of toner remaining on the sieve (toner not having passed through the sieve). An agglomeration rate (% by mass) was calculated from the mass of the toner before the sifting and the mass of the toner after the sifting (mass of toner remaining on the sieve after the sifting) based on the following equation.

Agglomeration rate (% by mass)=100×(mass of toner after sifting)/(mass of toner before sifting).

The toner having an agglomeration rate of no greater than 50% by mass was evaluated as good. The toner having an agglomeration rate of greater than 50% by mass was evaluated as poor.

(Low-Temperature Fixability)

A printer ("FS-C5250DN" produced by KYOCERA Document Solutions Inc.) equipped with a roller-roller type heat and pressure fixing device (nip width: 8 mm) was modified so as to be capable of changing the fixing temperature for use as an evaluation apparatus. A ball mill was used to mix 100 parts by mass of a developer carrier (carrier for "TASKalfa5550ci" produced by KYOCERA Document Solutions Inc.) and 10 parts by mass of the sample (toner) for 30 minutes, thereby preparing a two-component developer. The prepared two-component developer was loaded into a developing device of the evaluation apparatus, and a sample (toner for replenishment use) was loaded into a toner container of the evaluation apparatus.

Paper (A4 size plain paper) having a basis weight of 90 g/m$^2$ was conveyed at a linear velocity of 200 mm/sec. in an environment at a temperature of 23° C. and a humidity of 60% RH. A solid image (specifically, a toner image yet to be subjected to fixing) was formed on the paper being conveyed using the evaluation apparatus under a condition of a toner applied amount of 1.0 mg/cm$^2$. Subsequently, the paper on which the image has been formed was allowed to pass through the fixing device of the valuation apparatus. The transit time of paper through a nip of the fixing device was 40 ms. The fixing temperature ranges from at least 100° C. to no greater than 200° C. Specifically, a lowest temperature (lowest fixing temperature) at which a toner (solid image) was fixable was measured while the fixing temperature of the fixing device was increased gradually from 100° C. Whether or not toner fixing was accomplished was checked by a fold-rubbing test (measurement of the length of toner peeling of the fold portion) as described below.

The fold-rubbing test was performed on the paper having passed through the fixing device. Specifically, the paper with the solid image fixed thereon was folded in half such that a surface with the solid image thereon was folded inwards. A 1-kg weight covered by cloth was rubbed back and forth ten times on the fold. Next, the paper was opened up and a fold portion (i.e., a portion of the paper on which the solid image was fixed) was observed. The length of toner peeling of the fold portion (peeling length) was measured. A minimum fixing temperature was determined to be the lowest temperature among temperatures for which the peeling length was no greater than 1 mm.

A toner having a lowest fixing temperature of no greater than 150° C. was evaluated as good. A toner having a lowest fixing temperature of greater than 150° C. was evaluated as poor.

[Evaluation Results]

Table 5 indicates evaluation results of the toners TA-1 to TE.

TABLE 5

| | Toner | High-temperature preservability [% by mass] | Lowest fixing temperature [° C.] |
|---|---|---|---|
| Example 1 | TA-1 | 26 | 146 |
| Example 2 | TB-1 | 25 | 150 |
| Example 3 | TB-3 | 23 | 150 |
| Example 4 | TC | 27 | 146 |
| Example 5 | TD | 34 | 150 |
| Example 6 | TE | 22 | 148 |
| Comparative Example 1 | TA-2 | 15 | 155 (poor) |
| Comparative Example 2 | TA-3 | 58 (poor) | 144 |
| Comparative Example 3 | TB-2 | 55 (poor) | 146 |

The toners TA-1, TB-1, TB-3, TC, TD, and TE (toners of Examples 1-6) each had the above basic structure. Specifically, the shell layers of the toners of Examples 1-6 each included the first and second domains. The first and second domains each included a copolymer of at least one monomer that is a monomer having a mole fraction of at least 20 mol % and at least one additional monomer that is a monomer having a mole fraction of less than 20 mol % (see Tables 2-4). The difference in polymer SP value between the main monomers of the first and second domains calculated according to Fedors' method was at least 0.5 and no greater than 5.0 (see Tables 2-4). In the toners of Examples 1-6, at least one common monomer (low-Tg common monomer) having a homopolymerization glass transition point of no greater than −20° C. was included in the additional monomers of each of the first and second domains.

Furthermore, in the toner of Examples 1-6, the total amount of all the main monomer(s) of the copolymer included in the first domains and the total amount of all the main monomer(s) of the copolymer included in the second domains each are at least 80 mol % (see Tables 2-4).

As indicated in Table 5, the toners of Examples 1-6 were excellent in high-temperature preservability and low-temperature fixability.

What is claimed is:

1. An electrostatic latent image developing toner comprising a plurality of toner particles each including a core and a shell layer disposed over a surface of the core, wherein the shell layer has a first domain and a second domain, the first domain includes a first copolymer of at least one first main monomer and at least one first additional monomer, the at least one first main monomer being a monomer having a mole fraction of at least 20 mol %, the at least one first additional monomer being a monomer having a mole fraction of less than 20 mol %, the second domain includes a second copolymer of at least one second main monomer and at least one second additional monomer, the at least one second main monomer being a monomer having a mole fraction of at least 20 mol %, the at least one second additional monomer being a monomer having a mole fraction of less than 20 mol %, a difference in polymer SP value between the at least one first main monomer and the at least one second main monomer calculated according to Fedors' method is at least 0.5 and no greater than 5.0, and the at least one first additional monomer and the at least one second additional monomer each include at least one common monomer having a homopolymerization glass transition point of no greater than −20° C., and the at least one common monomer included in the at least one first additional monomer and the at least one common monomer included in the at least one second additional monomer are identical.

2. The electrostatic latent image developing toner according to claim 1, wherein the at least one common monomer included in the first copolymer and the at least one common monomer included in the second copolymer each have a mole fraction of at least 5 mol % and less than 20 mol %.

3. The electrostatic latent image developing toner according to claim 1, wherein the at least one first main monomer each have a homopolymerization glass transition point of 100° C. or more greater than the at least one common monomer, and the at least one second main monomer has a homopolymerization glass transition point of 100° C. or more greater than the at least one common monomer.

4. The electrostatic latent image developing toner according to claim 1, wherein the at least one first main monomer, the at least one second main monomer, and the at least one common monomer each are a vinyl compound.

5. The electrostatic latent image developing toner according to claim 4, wherein The at least one common monomer contains either or both of ethyl acrylate and butyl acrylate.

6. The electrostatic latent image developing toner according to claim 5, wherein the at least one first main monomer and the at least one second main monomer each are, independently of one another, at least one monomer selected from the group consisting of styrene, methyl methacrylate, and acrylonitrile.

7. The electrostatic latent image developing toner according to claim 1, wherein the first copolymer contains styrene as the at least one first main monomer, the second copolymer contains methacrylic acid alkyl ester as the at least one second main monomer, and the first and second copolymers each contain ethyl acrylate or butyl acrylate as the at least one common monomer.

8. The electrostatic latent image developing toner according to claim 1, wherein the first copolymer contains styrene and methacrylic acid alkyl ester each as the at least one first main monomer, the second copolymer contains styrene as the at least one second main monomer, and the first and second copolymers each contain ethyl acrylate or butyl acrylate as the at least one common monomer.

9. The electrostatic latent image developing toner according to claim 1, wherein the first copolymer contains acrylonitrile as the at least one first main monomer, the second copolymer contains methacrylic acid alkyl ester as the at least one second main monomer, and the first and second copolymers each contain ethyl acrylate or butyl acrylate as the at least one common monomer.

10. The electrostatic latent image developing toner according to claim 1, wherein a total amount of all the at least one first main monomer of the first copolymer included in the first domain and a total amount of all the at least one second main monomer in the second copolymer included in the second domain each are at least 80 mol %.

* * * * *